US005902055A

United States Patent [19]

Oshino et al.

[11] Patent Number: 5,902,055

[45] **Date of Patent: * May 11, 1999**

[54] THERMAL PRINTER HAVING A THERMAL HEAD AND PLATEN ROLLER

[75] Inventors: Genzi Oshino, Miyagi-ken; Masaaki Yoshikawa, Kanagawa-ken, both of Japan

[73] Assignee: Tohoku Ricoh, Co., Ltd., Miyagi-ken, Japan

[ * ] Notice: This patent is subject to a terminal disclaimer.

[21] Appl. No.: 08/924,957

[22] Filed: Sep. 8, 1997

Related U.S. Application Data

[62] Division of application No. 08/249,205, May 26, 1994, Pat. No. 5,697,713.

[30] Foreign Application Priority Data

May 31, 1993 [JP] Japan ..... 5-129517

[51] Int. Cl.[6] ..... B41J 2/32

[52] U.S. Cl. ..... 400/120.16; 347/197

[58] Field of Search ..... 400/120.16, 120.17; 347/197, 198

[56] References Cited

U.S. PATENT DOCUMENTS

| | | | |
|---|---|---|---|
| 4,342,040 | 7/1982 | Fujita et al. | 347/197 |
| 4,818,126 | 4/1989 | Brooks et al. | 400/120.16 |
| 5,255,012 | 10/1993 | Amano | 400/120.16 |
| 5,372,440 | 12/1994 | Slater | 400/120.16 |

FOREIGN PATENT DOCUMENTS

| | | | |
|---|---|---|---|
| 61-27467 | 1/1988 | Japan | 400/120.16 |
| 5-155101 | 6/1993 | Japan | 400/120.16 |

*Primary Examiner*—Christopher A. Bennett
*Attorney, Agent, or Firm*—Armstrong, Westerman, Hattori, McLeland & Naughton

[57] ABSTRACT

In a thermal printer for feeding a direct thermal paper or a thermal transfer ribbon and a printing paper between a thermal head and a platen roller while such paper is pressed and held by pressing force of a pressure application means, and printing on such paper by heating a heating portion of the thermal head, the positioning or the thermal head relative to the platen roller in the paper feeding direction can be easily performed by a simple mechanism without using an exclusive assembling instrument. To achieve this object, the thermal head and the platen roller are attached to the same member or members which are integrated with each other and there is provided a linear moving mechanism for moving the thermal head and the platen roller toward or away from each other while one of the thermal head and the platen roller is held by the pressure application means so as to be movable linearly in the pressure application direction, whereby the thermal head is brought into contact with the platen roller or vice versa by merely linearly moving the thermal head or the platen roller.

4 Claims, 14 Drawing Sheets

THERMAL PRINTER HAVING A THERMAL HEAD AND PLATEN ROLLER

This is a divisional of application Ser. No. 08/249,205 filed May 26, 1994, now U.S. Pat. No. 5,697,713.

FIELD OF THE INVENTION

The present invention relates to a thermal printer for printing on a printing paper using a thermal head and a platen roller.

DESCRIPTION OF PRIOR ART

In the thermal printer for printing on a printing paper using a thermal head and a platen roller, it is required to accurately position the thermal head relative to the platen roller in the paper feeding direction so as to enhance printing quality.

To meet this requirement, in the prior art thermal printer as shown in FIG. 15, a standard type thermal head 10 is held, e.g. by a thermal head holding mechanism and it is positioned relative to a platen roller 2 in the paper feeding direction.

In this thermal head holding mechanism, a rear end of a head plate 62 to which the thermal head 10 is integrally fixed is swingably held by a head frame 63 by way of a tension spring 61. A front end of the head plate 62 is pressed against the platen roller 2 by a free end of a leaf spring 64 which is fixed to the head frame 63 at one end thereof by way of an L-shaped supporting member 63*a*.

The head frame 63 is supported by a supporting shaft 69 at the rear end lower portion thereof so as to be turned in the direction of the arrow B and it is always urged clockwise by a tension spring 60 which is attached to the upper surface thereof so as to contact at its upper surface to a press cam 66 which is turned by a pressure application lever 65.

Accordingly, if the pressure application lever 65 is raised from a substantially horizontal position to a substantially perpendicular position, i.e. to the position as shown in FIG. 15, the head frame 63 is turned counterclockwise about the supporting shaft 69 so that the swingable head plate 62 is pressed downward by the leaf spring 64. At this time, the pressing force from the leaf spring 64 acts aslant on the pressure application portion of the head plate 62 so that the head plate 62 is pressed downward together with the thermal head 10 and it is slightly moved forward (leftward in FIG. 15).

Accordingly, as shown in FIG. 16, a striking portion 62*a* of the head plate 62 is brought into contact with an outer peripheral surface of a shaft 68 which is coaxial with a shaft 67 of the platen roller 2 so that the thermal head 10 is positioned relative to the platen roller 2 in the paper feeding direction. At this state, the thermal head 10 is pressed against the platen roller 2 with a given pressing force.

However, the thermal head 10 must be free in two directions, i.e. firstly in the direction to press thermal head 10 against the platen roller 2 (hereinafter referred to as pressure application direction) and secondly in the paper feeding direction, i.e. the direction to feed a printing paper 4 and a thermal transfer ribbon 3 so as to position the thermal head 10 relative to the platen roller 2 in such a holding mechanism. As a result, the thermal head holding mechanism is complex and the parts thereof are increased, thereby generating the problem that the thermal printer is difficult to be miniaturized.

Furthermore, in the thermal head of the prior art thermal printer, the thermal head 10 integrated with the head plate 62 is incorporated into the thermal printer as a head unit of the thermal printer. As a result, the positioning of the thermal head relative to the platen roller becomes always same when the head unit is assembled with the thermal printer even if any person replace the head unit as another one. It is required assembling accuracy of the thermal head relative to the head plate as the head unit. To achieve such high assembling or incorporating accuracy, an exclusive assembling instrument by which high assembling or incorporating accuracy is obtained in a factory must be used to obtain the head unit by incorporating the thermal head into the head plate.

SUMMARY OF THE INVENTION

The present invention has been made in view of the problems as set forth above and has an object to provide a thermal printer capable of easily positioning a thermal head, which influences printing quality, relative to the platen roller in the paper feeding direction without using an exclusive assembling instrument and to miniaturize the printer as a whole by simplifying a thermal head holding mechanism.

To achieve the above object, in the thermal printer for feeding a direct thermal paper or a thermal transfer ribbon and a printing paper between a thermal head and a platen roller while such paper is pressed and held by pressing force of a pressure application means, and printing on such paper by heating a heating portion of the thermal head, the thermal head and the platen roller are attached to the same member or members which are integrated with each other and a linear moving mechanism is provided for moving the thermal head toward or away from the platen roller while one of the thermal head and the platen roller is held by a pressure application means so as to be movable linearly in the pressure application direction.

With the arrangement of the thermal printer, since at least one of the thermal head and the platen roller is linearly movable by the linear moving mechanism in the direction to move toward or away from the other, it is possible to permit the thermal head and the platen roller to bring into contact with each other so as to perform printing by merely linearly moving them in the direction to approach each other.

Since the liner moving mechanism is the one to move the thermal head or the platen roller in one linear direction alone, the thermal printer can be simplified in its structure, miniaturized and the number of parts thereof can be reduced compared with the prior art thermal printer having the thermal head holding mechanism which is free both in the pressure application direction and in the paper feeding direction.

Furthermore, since the thermal head and the platen roller are attached to the same member or members which are integrated with each other, they can be positioned easily with high accuracy so that the thermal head can be accurately positioned relative to the platen roller in the paper feeding direction even if they are linearly moved, namely, in one direction by the linear moving mechanism.

Still furthermore, if the thermal head or the platen roller or both of them are attached to a structural element of the thermal printer, the number of parts of the thermal printer can be more reduced and the thermal printer can be more strong.

The above and other objects, features and advantages of the invention will be apparent from the following detailed description which is to be read in conjunction with the accompanying drawings.

DETAILED DESCRIPTION OF THE PREFERRED EMBODIMENT

First Embodiment (FIGS. 1 to 5)

Figure 1:
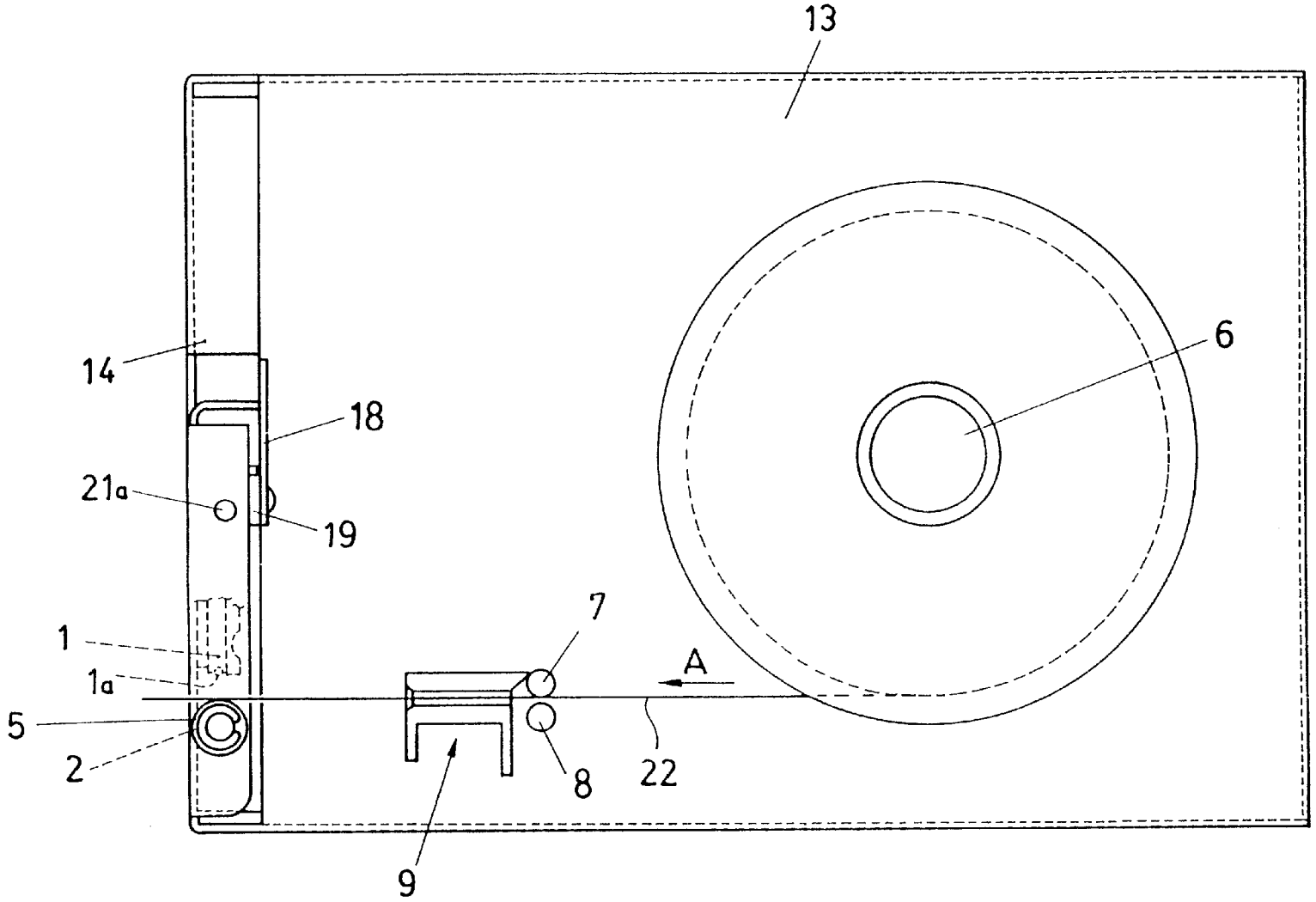
FIG. 1 is a schematic arrangement of an entire thermal printer according to a first embodiment of the invention.

A thermal printer according to a first embodiment of the present invention will be described with reference to FIGS. 1 to 5. An entire arrangement of this thermal printer will be first described with reference to FIG. 1.

In this thermal printer, a direct thermal paper 22 is passed through between an edge type thermal head 1 and a platen roller 2 fixed to an innermost bearing 5, then the direct thermal paper 22 is pressed and clamped by pressing force of a pressure application means, described later, thereby printing on the direct thermal paper 22 by heating a heating portion of the thermal head 1.

When the thermal printer is used, the direct thermal paper 22 wound in a rolled state is set on a supply shaft 6 while a free end of the direct thermal paper 22 is pulled out, then it is passed through between an upper paper guide 7 and a lower paper guide 8, then it is also passed through a paper sensor 9 and finally it is set between the thermal head 1 and the platen roller 2.

The direct thermal paper 22 is selectively heated by a heating portion 1*a* of the thermal head 1 so that a desired image is printed on the direct thermal paper 22.

The paper sensor 9 is provided for controlling a feeding pitch of the direct thermal paper 22 in the direction of an arrow A.

The supply shaft 6 for holding the direct thermal paper 22 wound in a rolled state is attached to a main frame 13 serving as a structural element of this thermal printer like the upper paper guide 7, the lower paper guide 8, the paper sensor 9, etc. A front frame 14 serving also as the structural element is integrally fixed to the main frame 13 which is positioned perpendicular relative to the main frame 13 at left side in FIG. 1 and the thermal head 1 and the platen roller 2, etc. are respectively attached to the front frame 14.

Figure 2B:
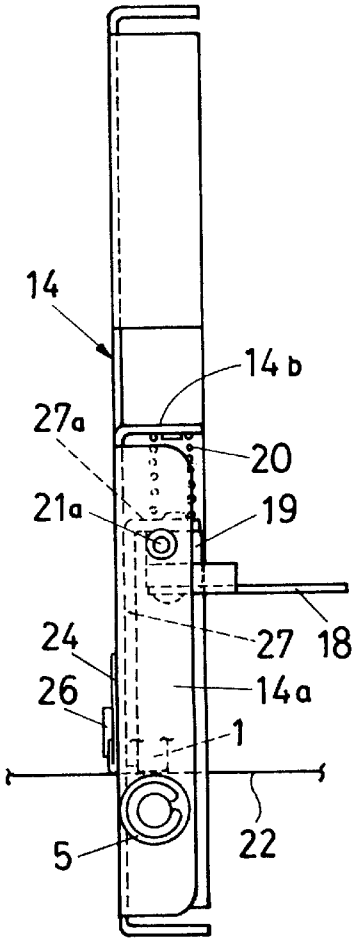
FIGS. 2A and 2B are front and side views each showing main elements of the thermal printer of FIG. 1 which are attached to a front frame.
Figure 2A:
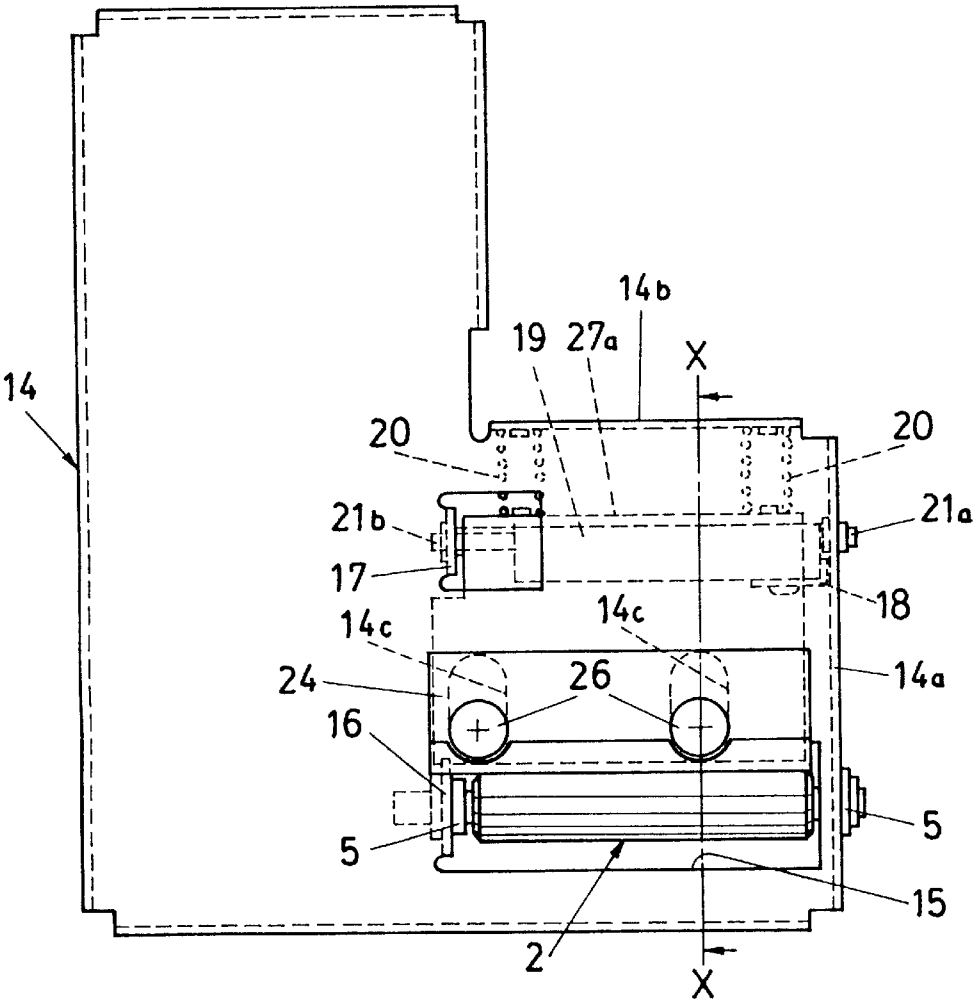

The front frame 14 has bent portions 14*a* and 14*b* which are formed by bending end edge portions of a metal plate at right angles which is cut in substantially L-shape and also bending other end edge portions as shown in FIGS. 2A and 2B. There are also formed a rising portion 17 at the substantially central portion of the front frame 14 as shown in FIG. 2A and a lengthwise opening 15 at the lower portion thereof for holding the platen roller 2. The platen roller 2 is rotatably supported by a rising portion 16 and the bent potion 14a of the front frame 14, which are confronted with each other in the opening 15 in FIG. 2A, by way of bearings 5 and 5.

Figure 4:
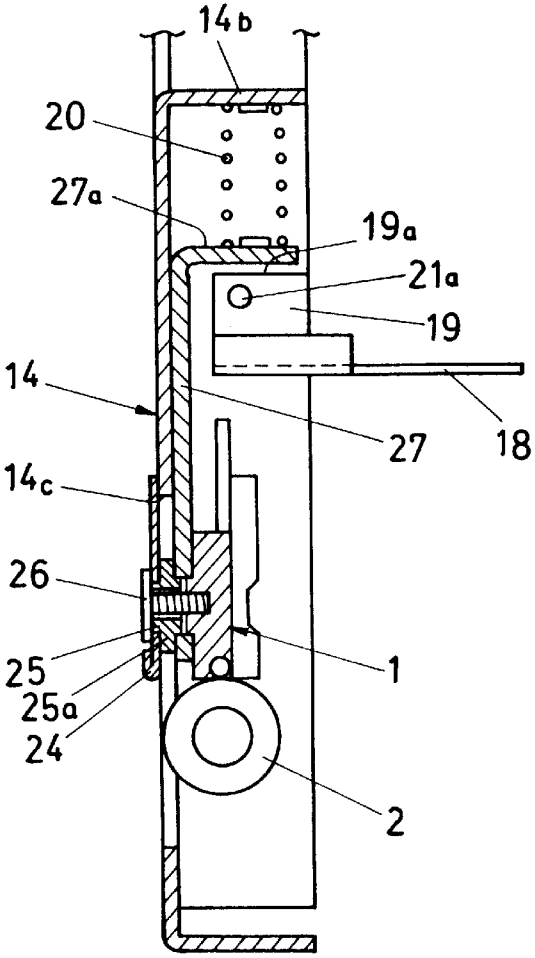
FIG. 4 is a cross-sectional view taken along X—X in FIG. 2A, wherein a thermal head holding mechanism of the thermal printer is enlarged.
Figure 5:
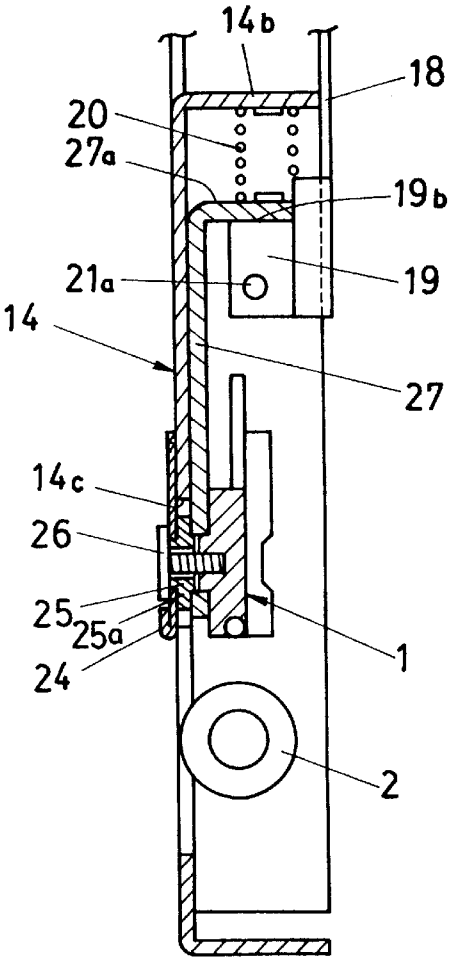
FIG. 5 is a cross-sectional view of the thermal printer taken along X—X in FIG. 3, like FIG. 4, showing the state where the thermal head is moved away from the platen roller.

A head plate 27 is provided above the platen roller 2 and inside the front frame 14 at right side in FIG. 2B so as to be movable vertically linearly while two spacers 25 and 25, as shown in FIGS. 4 and 5, are attached to the head plate 27 leaving a given space therebetween and in a lateral direction in FIG. 2A. Two spacers 25 and 25 are engaged in inverted U-shaped guide holes 14*c* and 14*c* as shown in FIGS. 4 and 5 which are formed in the front frame 14 along vertical directions thereof (refer to FIG. 2A), whereby the head plate 27 can linearly moved in the vertical direction alone.

The spacers 25 each has a collar portion 25*a* at its central portion which is engaged in a guide hole 14*c* without jolting and the edge type thermal head 1 is screwed by and fixed to a screw 26 which is engaged in the central hole of each spacer 25. As a result, the thermal head 1 is horizontally fixed between two spacers 25, 25.

The screw 26 is screwed between its head and the spacers 25 and 25 while intervening a release plate 24 therebetween.

Accordingly, the release plate 24, the spacer 25 and the thermal head 1 are movable linearly vertically alone along the guide holes 14*c* and 14*c* of the front frame 14 together with the head plate 27.

A spring receiver surface 27a is formed by bending the upper end of the head plate 27 at right angles and the pressure application springs 20 and 20 serving as the pressure application means are provided leaving a given space therebetween as shown in FIG. 2A between the spring receiver surface 27*a* and a bent portion 14*b* of the front frame 14 which is disposed in parallel with the spring receiver surface 27*a*. The head plate 27 is pressed downward by the resiliency of the springs 20 and 20 so as to always urge the thermal head 1 against the platen roller 2.

An angled shaft 19 is provided in parallel with the spring receiver surface 27*a* under the spring receiver surface 27*a* while angled shaft pins 21*a* and 21*b* are fixed to both end surfaces of the angled shaft 19 while they are provided eccentrically and confronted with each other and supported by the bent portion 14*a* of the front frame 14 and the rising portion 17 by way of the bearings 5 and 5.

A release lever 18 is screwed by and fixed to the angled shaft 19 by a screw at the right lower surface thereof in FIG. 2A. When the release lever 18 is turned until it reaches a horizontal position as shown in FIG. 4, there is defined a gap between a surface 19*a* of the angled shaft 19 close to the angled shaft pin 21*a* and a surface of the head plate 27 opposite to the spring receiver surface 27*a*. As a result, the head plate 27 is pressed downward by the resiliency of the pressure application spring 20, whereby the thermal head 1 is brought into contact with the platen roller 2 in a given pressing force adapted for printing.

When the release lever 18 is turned counterclockwise and raised until it reaches a perpendicular state as shown in FIG. 5, a contacting surface 19*b* of the angled shaft 19 which is remote from the angled shaft pin 21*a* of the angled shaft 19 is brought into contact with the surface opposite to the spring receiver surface 27*a* of the head plate 27 so that the head plate 27 is pushed upward against the resiliency of the pressure application spring 20, whereby the application of pressure of the thermal head 1 relative to the platen roller 2 is released so that the thermal head 1 is moved away from the platen roller 2.

Figure 3B:
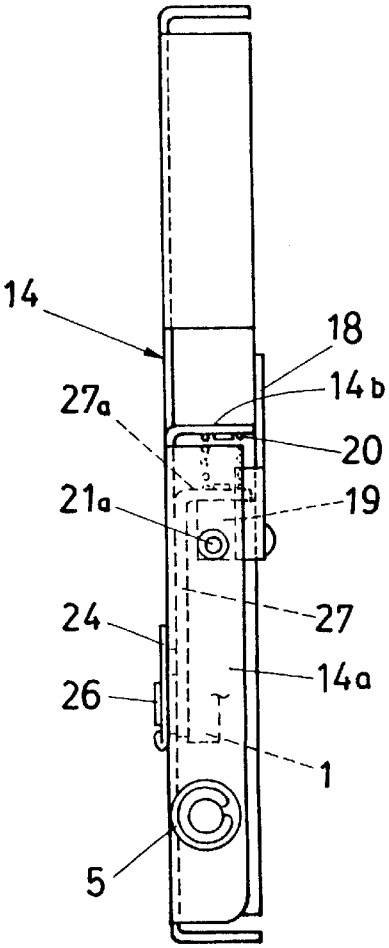
FIGS. 3A and 3B are front and side views each showing the state where a thermal head is moved away from a platen roller of the thermal printer of FIG. 1.
Figure 3A:
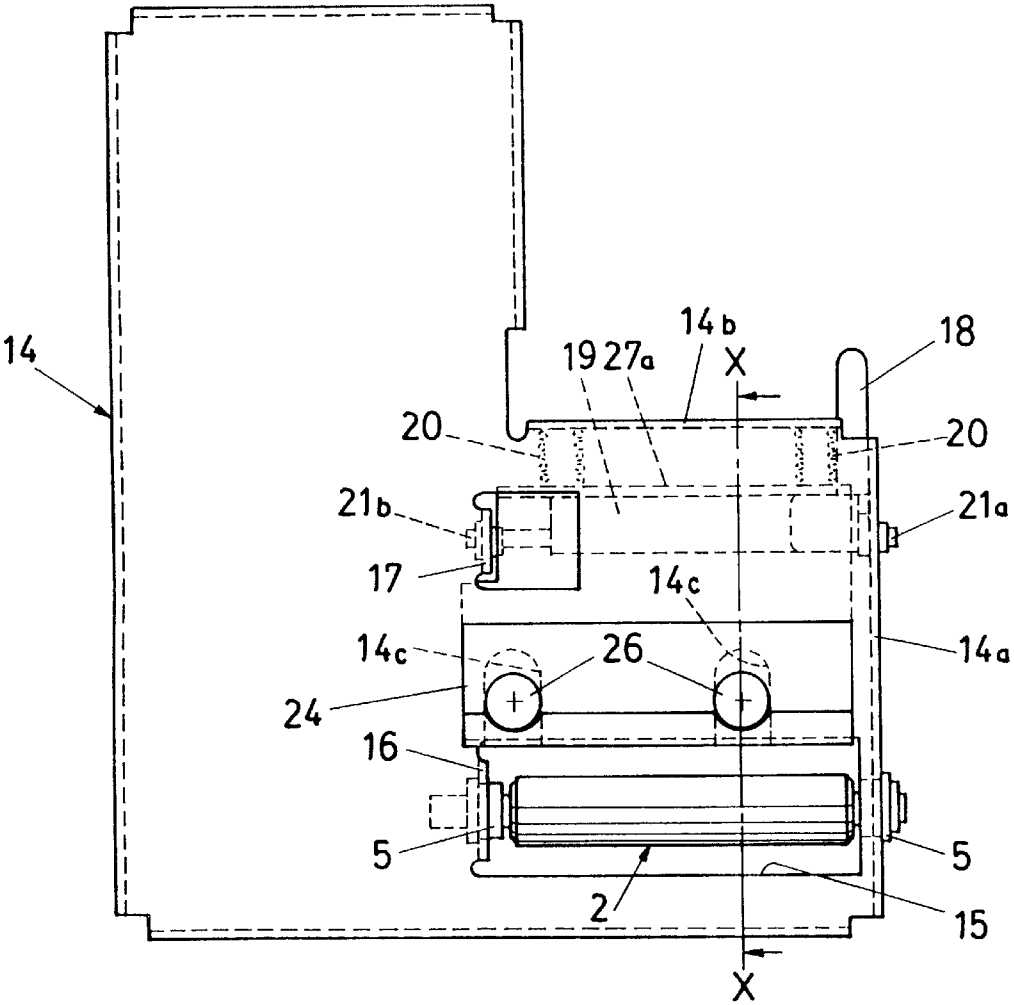

FIGS. 3A and 3B show the state where the thermal head 1 is moved away from the platen roller 2. At this state, if the direct thermal paper 22 is inserted into the opening 15 and set, the direct thermal paper can be easily set. At the time of replacing the thermal head 1 with a new one, detailed explanation of which will be described later, the thermal head 1 is likewise moved away from the platen roller 2 in the aforementioned manner and then the release lever 18 is returned to the horizontal position as shown in FIG. 2B after replacement of the thermal head 1, thereby returning the thermal printer at the original state where the printing can be performed.

According to the first embodiment, the thermal head 1 can be brought into contact with the platen roller 2 at a printable state by merely linearly moving the thermal head 1 together with the head plate 27 by a linear moving mechanism comprising two guide holes 14*c* and 14*c*, the spacers 25 and 25 which are movably inserted into the guide holes 14*c* and 14*c*, the head plate 27, the angled shaft 19 as the operating member, the release lever 18, etc.

Since the linear moving mechanism is the mechanism to move the thermal head 1 relative to the platen roller 2 in the one direction, i.e., the pressure application direction alone, the thermal printer can be miniaturized and the parts thereof can be reduced compared with the prior art thermal printer having the thermal head holding mechanism which is free in the pressure application direction and in the paper feeding direction.

Furthermore, since the thermal head 1 and the platen roller 2 are respectively attached to the front frame 14 serving as the structural element, the thermal head 1 and the platen roller 2 can be easily positioned relative to each other. Accordingly, it is possible to accurately position the thermal head 1 relative to the platen roller 2 in the paper feeding direction, i.e. left and right in FIG. 1 by merely linearly moving the thermal head 1 in the aforementioned one direction alone. As a result, high printing quality can be obtained.

Since the thermal head is structured to be moved in the direction to move the thermal head 1 relative to the platen roller 2 in the one direction alone without influencing the positional displacement in the paper feeding direction, it is not necessary to use the head unit of the prior art thermal printer by which the thermal head 1 is integrally fixed to the head plate with high accuracy in the paper feeding direction.

Accordingly, it is possible to keep the positioning accuracy of the thermal head 1 relative to the platen roller 2 in the paper feeding direction within a given extent where high printing quality can be always obtained by merely controlling the accuracy of the parts such as the front frame 14 for holding the thermal head 1 and the platen roller 2 in a given extent without using the exclusive assembling instrument.

When the thermal head 1 is replaced with another one, the screw 26 is loosened to thereby remove the thermal head 1 and is replaced with the new thermal head 1 and thereafter the screw 26 is screwed again at its original state, thereby performing the replacement of the thermal head 1 with ease. In case of assembling the head unit with the front frame after replacing the thermal head 1 with the new one outside the factory for manufacturing the thermal printer, the positioning accuracy of the thermal head 1 relative to the platen roller 2 is scarcely varied.

According to the first embodiment, a cam shaft, etc. may be replaced by the angled shaft 19 as the operating member for linearly moving the head plate 27 when it is displaced in two positions, i.e. one position to move toward the head plate 27 and the other position to move away from the head plate 27 by turning the release lever 18. This is applied to other embodiments, described later.

Second Embodiment (FIGS. 6, 7A, 7B and 8B)

A thermal printer according to a second embodiment of the present invention will be described with reference to FIGS. 6 to 8B. Elements corresponding to those of the first embodiment as shown in FIGS. 1 to 5 are denoted at the same numerals.

Figure 6:
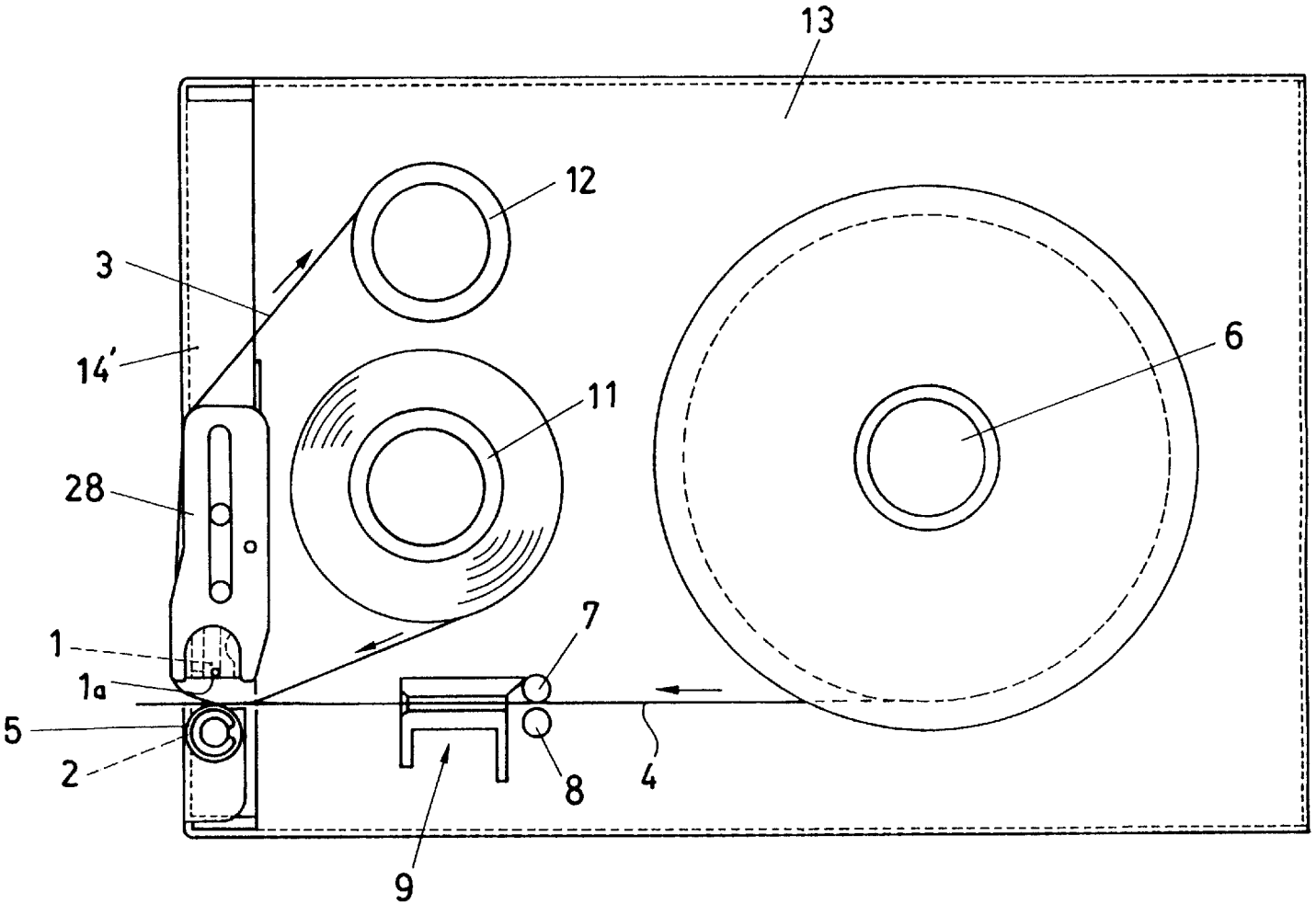
FIG. 6 is a schematic arrangement of an entire thermal printer according to a second embodiment of the invention.

FIG. 6 shows an entire schematic arrangement of the thermal printer. According to this thermal printer, the thermal transfer ribbon 3 and the printing paper 4 are fed while they are pressed and held by pressing force of the pressure application means between the thermal head 1 and the platen roller 2 which is supported by the innermost bearing 5 and the heating portion 1*a* of the thermal head 1 is heated to thereby print on the printing paper 4.

When the thermal printer is used, the printing paper 4 wound in a rolled state is set on the supply shaft 6 while a free end of the printing paper 4 is pulled and it is passed through between the upper paper guide 7 and the lower paper guide 8, then it is also passed through the paper sensor 9 and it is set between the thermal head 1 and the platen roller 2. The thermal transfer ribbon 3 pulled out from a ribbon supply core 11 is set to be passed between the thermal head 1 and the platen roller 2 and wound on a winding ribbon core 12. As a result, the printing paper 4 and the thermal transfer ribbon 3 are pressed and held by the thermal head 1 and the platen roller 2 and then it is fed in the direction of the arrow so that a desired image is printed on the printing paper 4 by the thermal head 1.

The supply shaft 6, the ribbon supply core 11 and the winding ribbon core 12 are respectively attached to the main frame 13 as evident from FIG. 6. The thermal head 1 and the platen roller 2 are respectively attached to a front frame 14' in the same manner as the first embodiment.

Figure 8A:
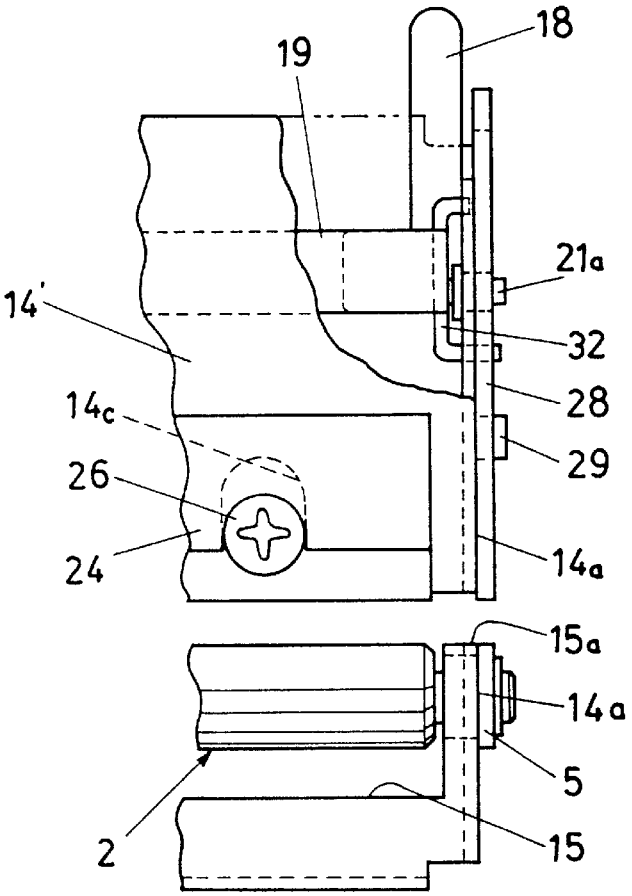
FIGS. 8A and 8B are partly broken enlarged front and side views each showing the state where a thermal head is moved away from a platen roller of the thermal printer of FIG. 6.

Although the front frame 14' is formed of a metallic plate which is cut in the substantially L shape in the same manner as the front frame 14 of the first embodiment, it is different of the front frame 14 in the following point. That is, as shown in FIG. 8A, a notched portion 15*a* is formed at the opening 15 for holding the platen roller 2 and the bent portion 14*a* of the front frame 14' is divided vertically into upper and lower side portions and the thermal transfer ribbon 3 and the printing paper 4 are inserted from the lateral direction between the thermal head 1 and the platen roller 2 through the notched portion 15*a* (FIG. 6).

Figure 7B:
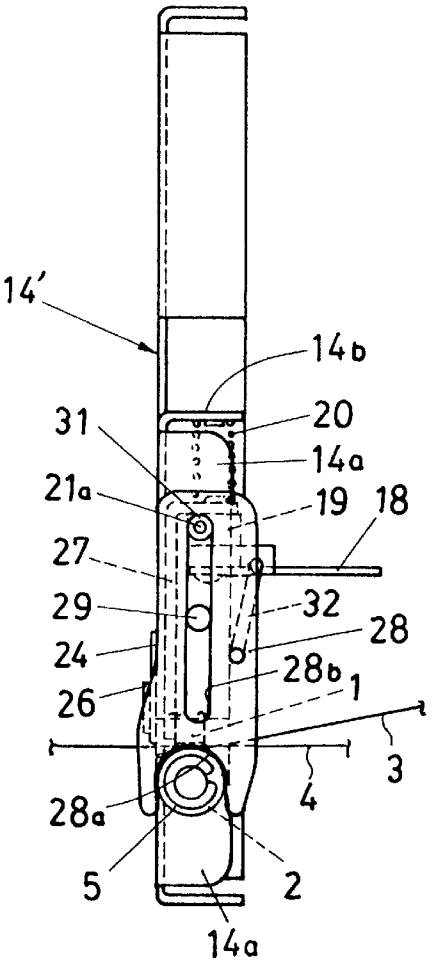
FIGS. 7A and 7B are front and side each views showing main elements of the thermal printer of FIG. 6 which are attached to a front frame.
Figure 7A:
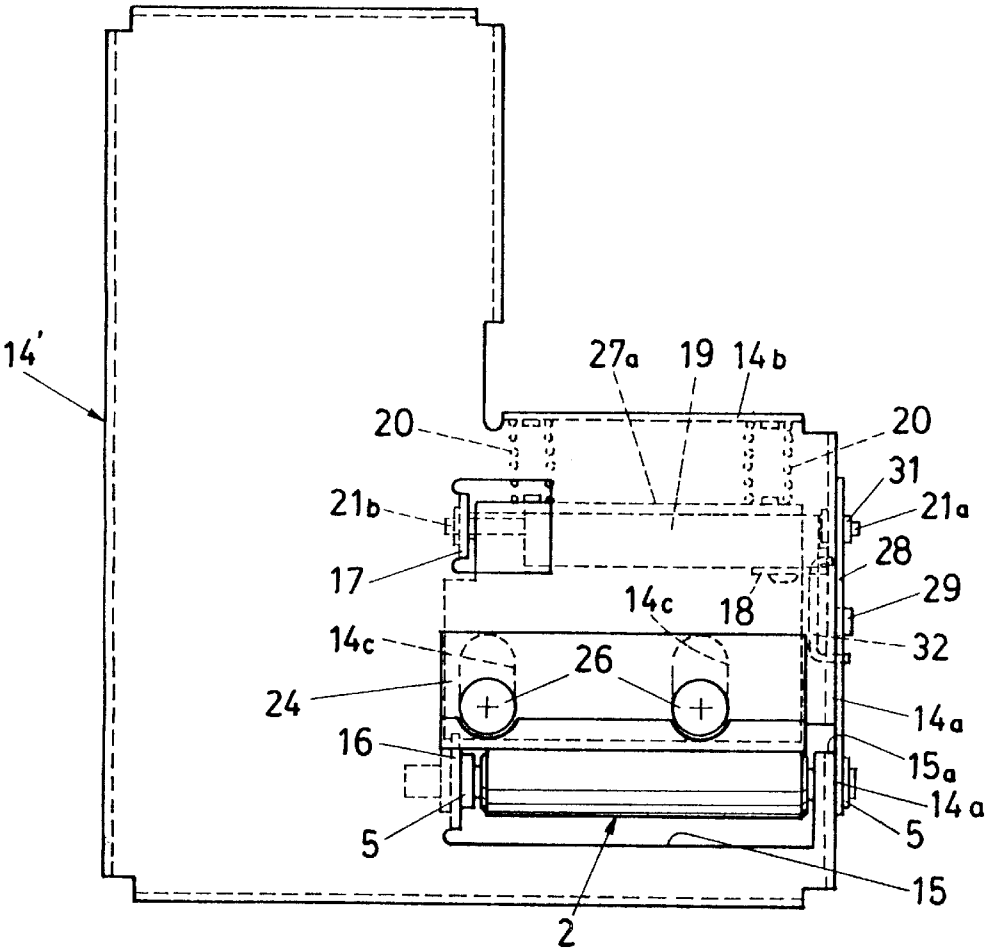
Figure 8B:
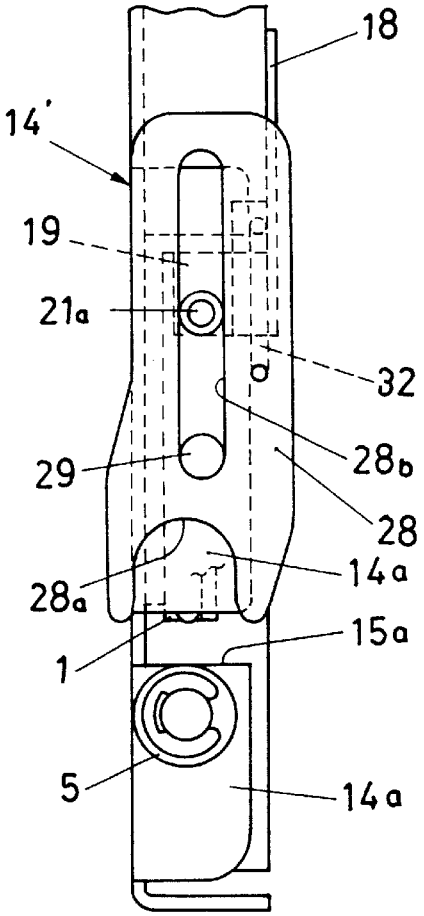

A positioning arm 28 is provided as a positioning member as shown in FIG. 7B at the right side of the front frame 14' in FIG. 7A. A U-shaped groove 28*a* having an opened lower portion and a long hole 28*b* are formed in the positioning arm 28 as shown in FIG. 8B. When the thermal head 1 is approached to the platen roller 2, the U-shaped groove 28*a* of the positioning arm 28 is engaged with the outer peripheral surface of the bearing 5 for supporting the shaft of the platen roller 2 as shown in FIG. 7B so that the thermal head 1 is positioned relative to the platen roller 2 in the paper feeding direction directing left and right in FIG. 7B.

A guide pin 29 riveted on the positioning arm 28 so as to protrude outside from the bent portion 14*a* of the front frame 14' and a bearing 31 for supporting the angled shaft pin 21*a* are respectively engaged in the long hole 28*b* of the positioning arm 28 formed long in the vertical direction so that the positioning arm 28 can be moved vertically alone. As evident from FIG. 8A, a connecting rod 32 is attached between the positioning arm 28 and the release lever 18 which is integrated with the angled shaft 19 serving as the operating member so as to be movable relative thereto.

When the release lever 18 is turned to the horizontal position in FIG. 7B, the positioning arm 28 is pushed downward and lowered by the connecting rod 32 so that the U-shaped groove 28*a* is engaged with the outer peripheral surface of the bearing 5 for supporting the platen roller 2 so that the thermal head 1 is accurately positioned relative to the platen roller 2 in the paper feeding direction.

When the release lever 18 is raised in the perpendicular state as shown in FIGS. 8A and 8B, the positioning arm 28 is pulled upward by the connecting rod 32 when the release lever 18 is turned so that the U-shaped groove 28*a* is moved away from the bearing 5. Accordingly, the U-shaped groove 28*a* is disengaged from the bearing 5 and the thermal head 1 is raised and is moved away from the platen roller 2. The angled shaft 19 has preferably an escape groove corresponding to, e.g., the configuration of the connecting rod 32 so that it does not interfere with the connecting rod 32 when the release lever 18 is raised in the perpendicular state.

As mentioned above, the printing paper 4 and the thermal transfer ribbon 3 can be easily set if the printing paper 4 and the thermal transfer ribbon 3 are set between the thermal head 1 and the platen roller 2 as explained with reference to FIG. 6 at the state where the thermal head 1 is moved away from the platen roller 2.

The width of the U-shaped groove 28*a* of the positioning arm 28 is slightly greater than the outer diameter of the bearing 5 for supporting the platen roller 2 within the extent to keep the positioning accuracy of the thermal head 1 relative to the platen roller 2. If inclined portions are provided in the opening of the U-shaped groove 28*a* at both sides thereof, the engagement of the U-shaped groove 28*a* with the bearing 5 can be smoothly performed.

Since the notched portion 15*a* is formed in the front frame 14' and the bent portion 14*a* is divided vertically into upper and lower side portions as shown in FIG. 8A, the upper side portion and the lower side portion are liable to be displaced relative to the notched portions 15*a* in the paper feeding direction directing left and right in FIG. 8B.

However, even if the displacement occurs in the paper feeding direction, the displacement can be corrected by bringing the thermal head 1 into contact with the platen roller 2 at the position where the release lever 18 is positioned as shown in FIGS. 7A and 7B so that the U-shaped groove 28*a* is engaged with the outer peripheral surface of the bearing 5. As a result, the thermal head 1 is accurately positioned relative to the platen roller 2 in the paper feeding direction.

Figure 9:
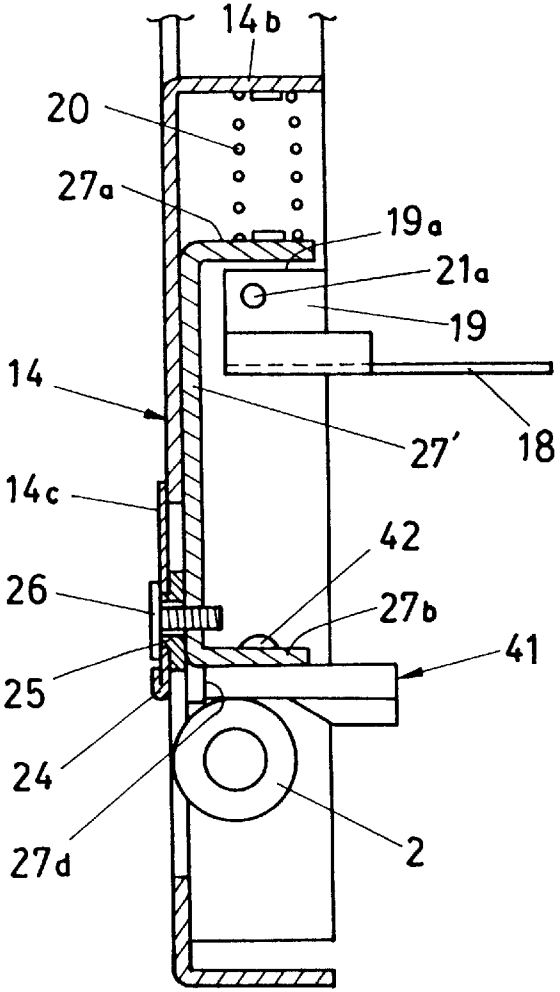
FIG. 9 is a cross-sectional view, like FIG. 4, showing the state where a thermal head of a thermal printer according to a third embodiment is brought into contact with a platen roller.
Figure 10:
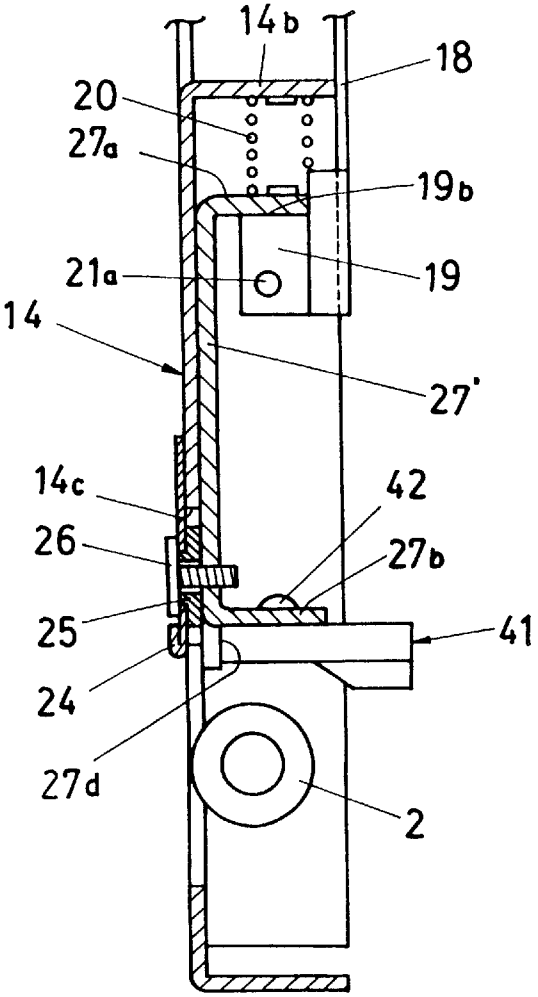
FIG. 10 is a cross-sectional view, like FIG. 5, showing the state where the thermal head is moved away from the platen roller.
Figure 11:
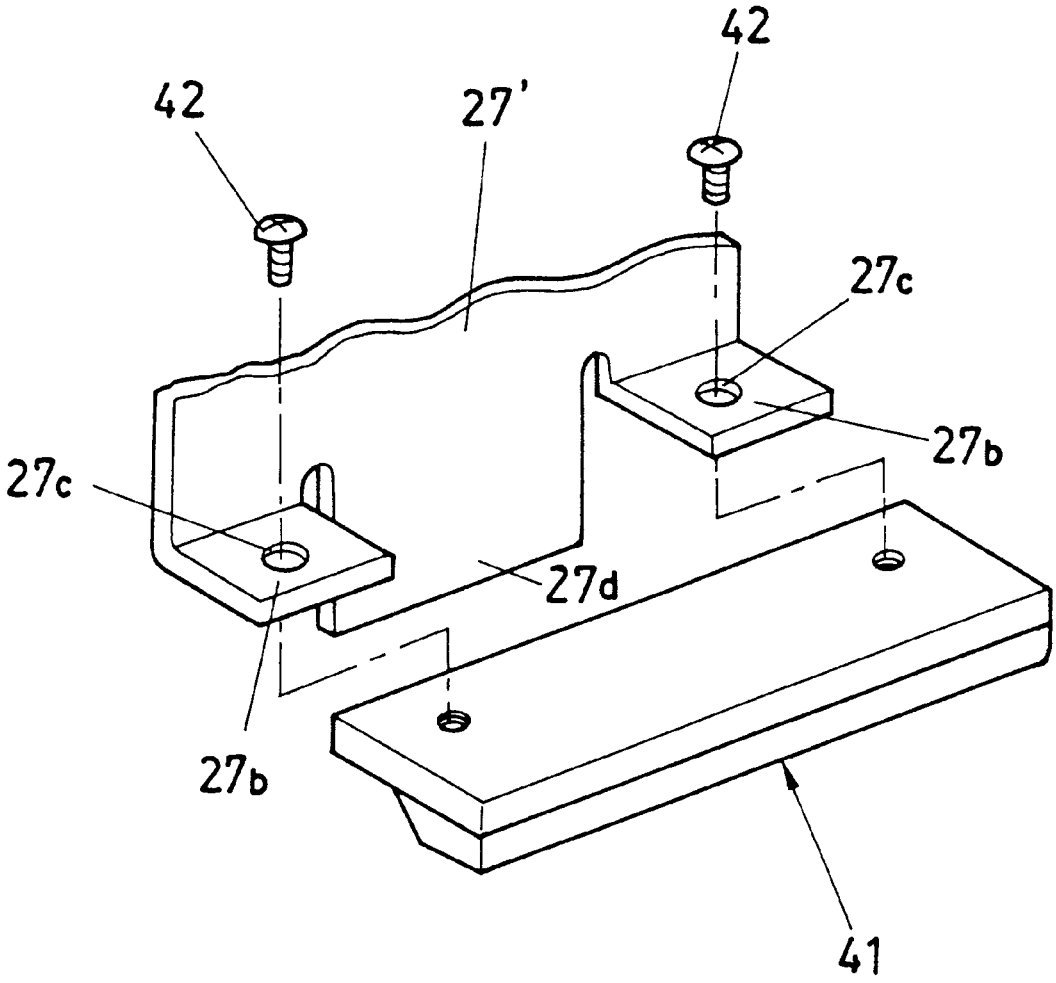
FIG. 11 is a perspective view of the thermal head and a head plate for holding the thermal head.

Third Embodiment (FIGS. 9 to 11)

A thermal printer using a standard type thermal head according to a third embodiment will be described with reference to FIGS. 9 to 11.

FIGS. 9 and 10 are respectively cross-sectional views like FIGS. 4 and 5 wherein FIG. 9 shows the state where a thermal head of a thermal printer is brought into contact with a platen roller and FIG. 10 shows the state the thermal head is moved away from the platen roller. Elements of FIGS. 9 and 10 corresponding to those in FIGS. 4 and 5 are denoted at the same numerals and the explanation thereof is omitted.

In this thermal printer, head attaching seats 27*b* and 27*b* are formed by bending the lower both ends of a head plate 27' and screws 42 and 42 are inserted into through holes 27*c* and 27*c* formed in the head attaching seats 27*b* and 27*b* wherein the screws 42 and 42 are screwed into screw holes respectively formed on the upper surface of the standard type thermal head 41, whereby the thermal head 41 is fixed to the head plate 27' as shown in FIGS. 9 and 10.

In the third embodiment, when replacing the thermal head 41 with a new one, two screws 42 and 42 are unloosened to thereby remove the thermal head 41 and the screws 42 and 42 are again screwed into the screw holes of a new thermal head replaced by the removed thermal head 41 while striking against a striking surface 27*d* of the head plate 27', whereby the replacement of the thermal head 41 can be easily replaced by the new one. Furthermore, the thermal head 41 can be accurately positioned relative to the platen roller 2 in the paper feeding direction by the thermal head striking surface 27*d*.

Figure 12B:
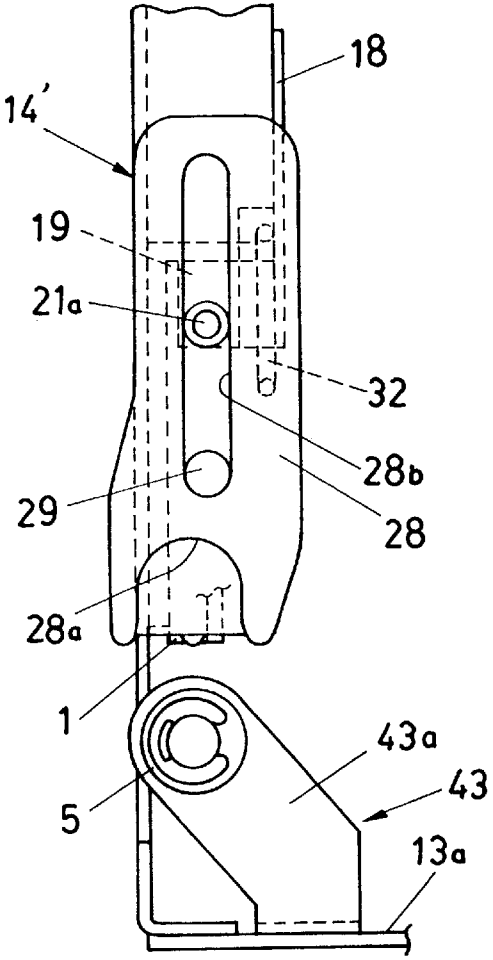
FIGS. 12A and 12B are front and side views, like FIGS. 8A and 8B, each showing a thermal printer according to a fourth embodiment of the invention.
Figure 12A:
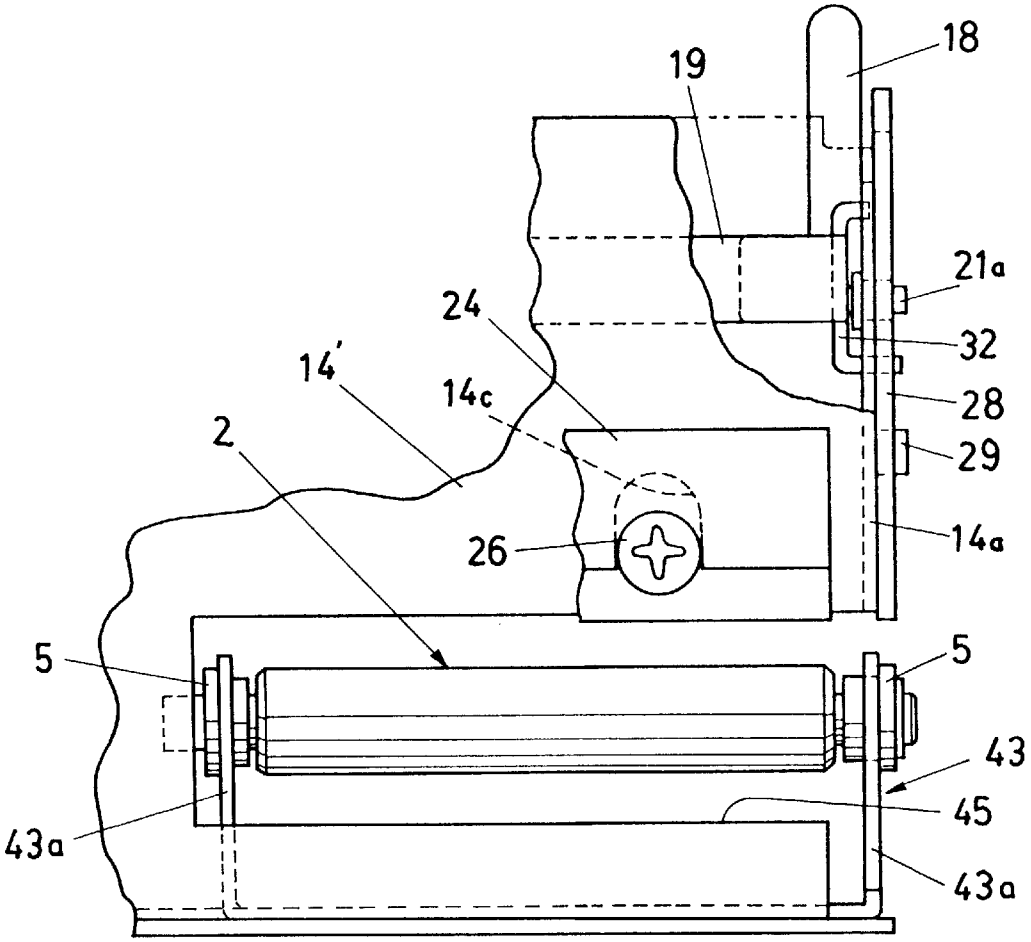

Fourth Embodiment (FIGS. 12A and 12B)

A thermal printer according to a fourth embodiment will be described with reference to FIGS. 12A and 12B wherein a thermal head side alone is attached to a front frame 14'. Elements of FIGS. 12A and 12B corresponding to those in FIGS. 8A and 8B are denoted at the same numerals.

An opening 45 is formed by largely cutting the right side of the front frame 14' as shown in FIG. 12A and the platen roller 2 is disposed in the opening 45.

The platen roller 2 is rotatably supported by a pair of supporting arms 43*a* and 43*a* which are formed in the platen roller supporting member 43 at the both ends thereof by way of the bearings 5 and 5 and the platen roller supporting member 43 is fixed to the bottoms surface 13*a* of the main frame 13, as shown in FIG. 12B.

Accordingly, the positioning accuracy of the thermal head 1 relative to the platen roller 2 in the paper feeding direction can be controlled within a given extent where a high printing quality can be always obtained without using the exclusive assembling instrument.

Fifth Embodiment (FIGS. 13A, 13B, 14A and 14B)

A thermal printer according to a fifth embodiment will be described with reference to FIGS. 13A to 14B wherein a thermal head is fix while the platen roller is movable.

Figure 13B:
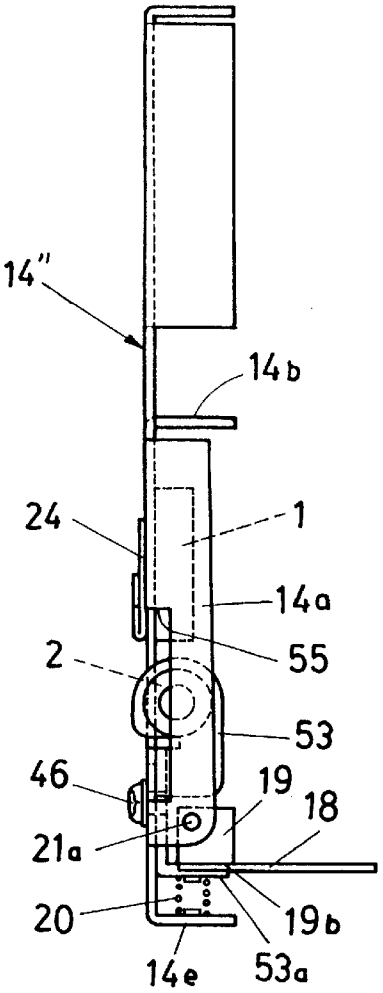
FIGS. 13A and 13B are front and side views each showing main elements of the thermal printer according to a fifth embodiment of the invention which are attached to a front frame.
Figure 13A:
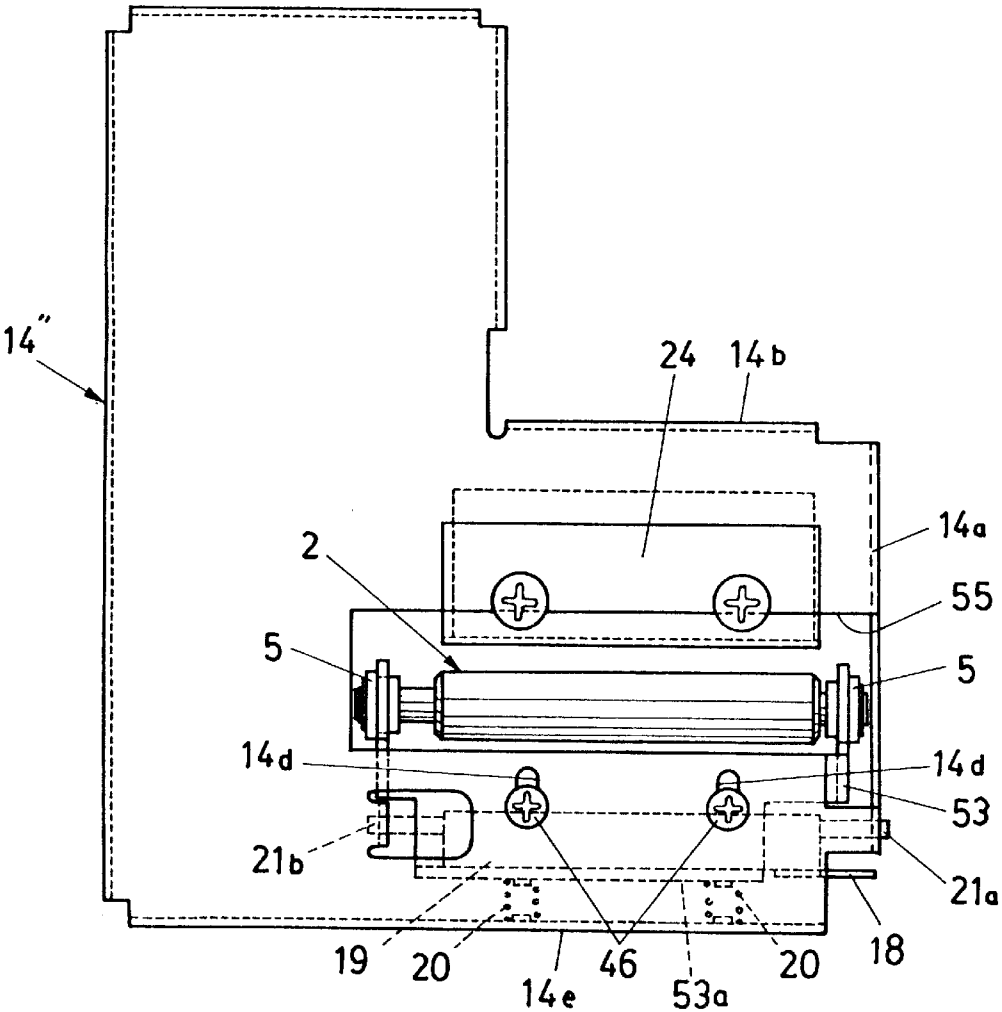
Figure 14B:
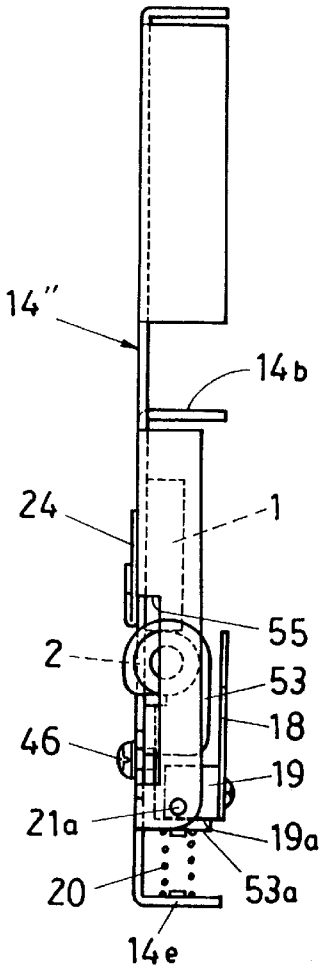
FIGS. 14A and 14B are front and side views each showing the state where a platen roller is brought into contact with a thermal head in FIGS. 13A and 13B.
Figure 14A:
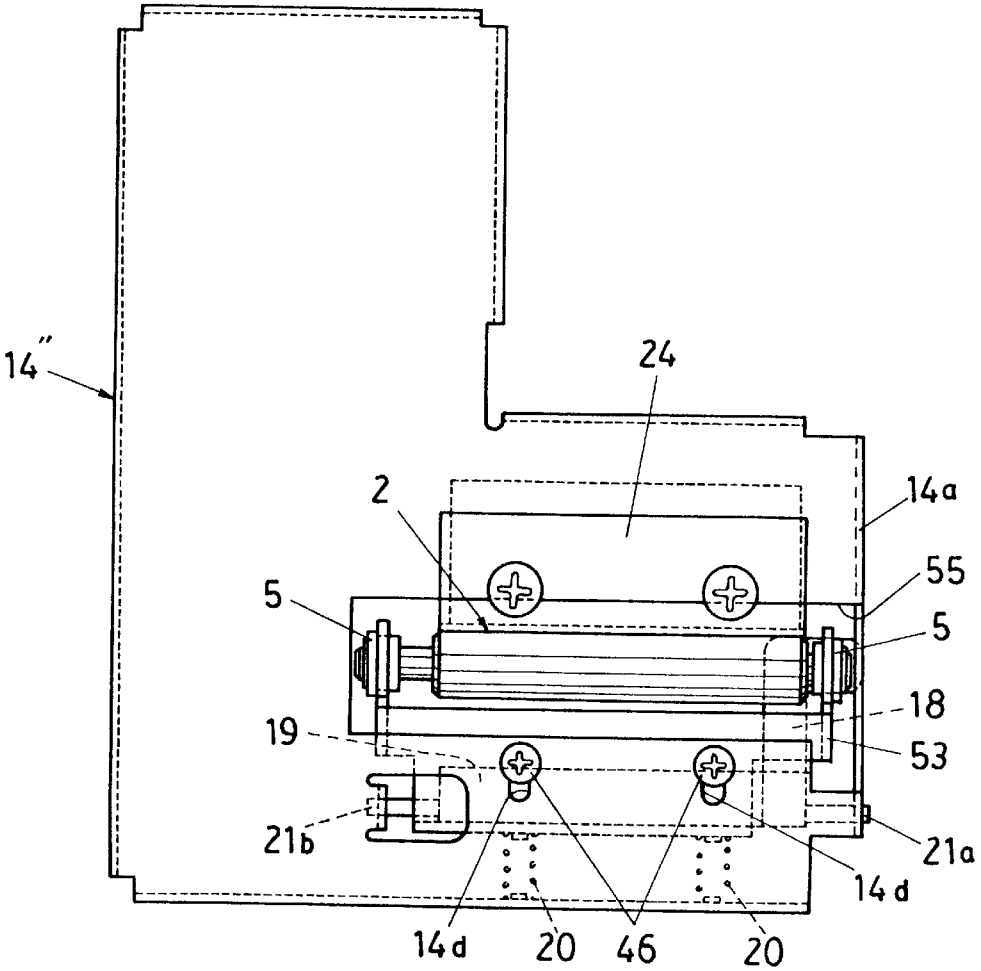
Figure 15:
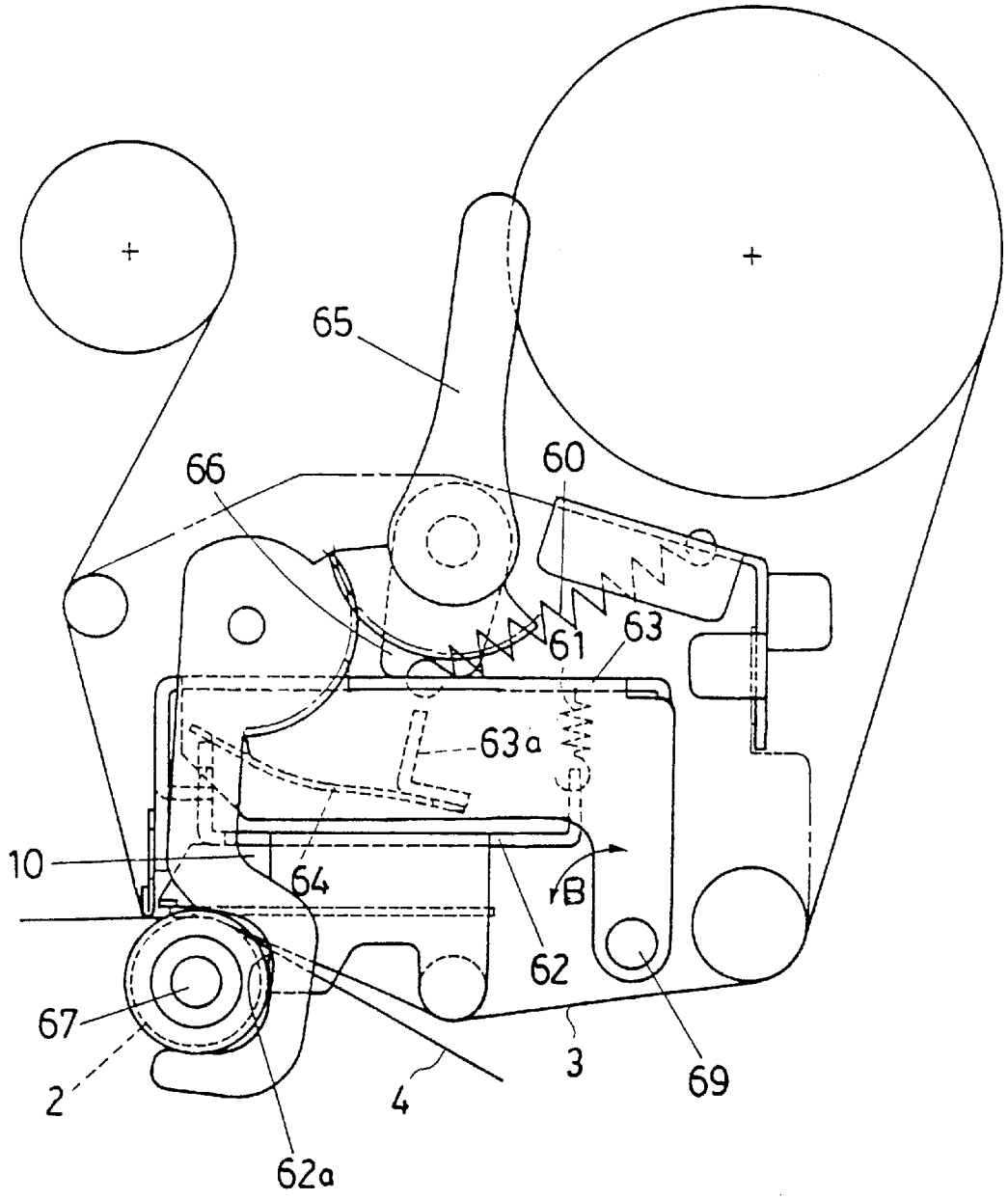
FIG. 15 PRIOR ART
FIG. 15 is a front view showing an example of a holding mechanism for holding a thermal head of a prior art thermal printer wherein the holding mechanism is movable freely in a pressure application direction and a paper feeding direction.
Figure 16:
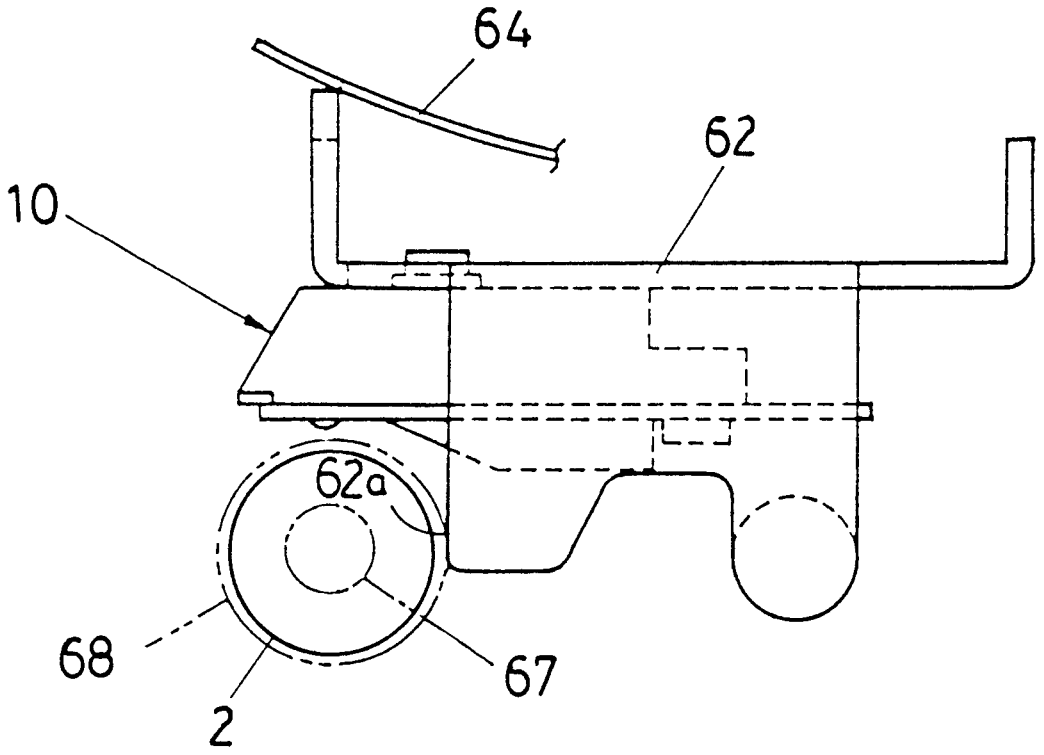
FIG. 16 PRIOR ART
FIG. 16 is a front view showing the thermal head of FIG. 15 and its periphery alone in FIG. 15.

FIGS. 13A and 13B are front and side views each showing the state where a platen roller is moved away from thermal head of a thermal printer and FIGS. 14A and 14B are front and side views each showing the state where the platen roller is brought into contact with the thermal head. Elements of FIGS. 13A to 14B corresponding to those in FIGS. 2A and 2B are denoted at the same numerals.

Although the thermal head and the platen roller are held by the pressure application means in the manner that the thermal head side is held to be movable linearly relative to the platen roller by the pressure application means according to the first to fourth embodiments, the platen roller side is movable relative to the thermal head according to the fifth embodiment.

That is, an opening 55 is formed in a front frame 14" at the position slightly over the position where the opening 15 of the first embodiment is formed and two long holes 14*d* and 14*d* are formed at the portion lower than the opening 55 leaving a given space therebetween.

Stepped screws 46 and 46 are inserted into the long holes 14*d* and 14*d* and then they are screwed into a platen roller supporting member 53 which rotatably supports the platen roller 2 by way of the bearings 5 and 5 so that the platen roller supporting member 53 is vertically linearly movable relative to the thermal head 1 in FIG. 13B, namely, in the direction to move toward or away from the thermal head 1.

The platen roller supporting member 53 has a spring receiving surface 53*a* at its lower side and it is always urged against the thermal head side by the resiliency of its pressure application springs 20 and 20 which are provided between the spring receiving surface 53*a* and the inner surface of a bent portion 14*e* of the front frame 14" confronting the spring receiving surface 53*a* leaving a given space therebetween. The angled shaft 19 which is the same as that as explained in FIGS. 2A and 2B is attached to the front frame 14" so as to be turned by the angled shaft pins 21*a* and 21*a* which protrude in eccentric relation from both ends of an upper surface side opposite to the spring receiving surface 53*a* of the platen roller supporting member 53.

When the release lever 18 integrally fixed to the angled shaft 19 is turned horizontally about the angled shaft pin 21*a* as shown in FIG. 13B, a contact surface 19*b* which is remote from the angled shaft pins 21*a* of the angled shaft 19 is brought into contact with a surface opposite to the spring receiving surface 53*a* of the platen roller supporting member 53. As a result, the platen roller supporting member 53 is pushed downward against the resiliency of the pressure application springs 20 and 20 so that the pressing of the platen roller 2 relative to the thermal head 1 is released, whereby both the platen roller 2 and the thermal head 1 are moved away from each other.

Whereupon, when the release lever 18 is turned counterclockwise to be raised in the perpendicular state as shown in FIG. 14B, there is defined a gap between a surface 19*a* of the angled shaft 19 close to the angled shaft pins 21*a* of the angled shaft 19 and a surface which is opposite to the spring receiving surface 53*a* and confronts the surface 19*a*. As a result, the platen roller supporting member 53 is pushed upward by the resiliency of the pressure application spring 20 and the platen roller 2 is brought into contact with the thermal head 1 in a given pressing force adapted for printing.

As mentioned above, even if the platen roller side is linearly movable relative to the thermal head 1, there can be obtained the same effects as those of the first to fourth embodiments.

The fifth embodiment can be applied to the second embodiment. That is, the printer roller side of the thermal printer of the second embodiment, as shown in FIGS. 6 to FIG. 8B in which the thermal transfer ribbon and the printing paper are inserted between the thermal head and the platen roller from the lateral direction, is moved toward the thermal head side like the fifth embodiment. In this case, since the notched portion 15*a* through which the thermal transfer ribbon and the printing paper are passed must be formed in the front frame 14', the bent portion 14*a* is divided into upper and lower side portions as shown in FIG. 8A, the upper side portion and the lower side portion are liable to be displaced in the paper feeding direction directing left and right in FIG. 8B.

However, such displacement can be prevented by providing the positioning arm having an engaging groove such as the U-shaped groove 28*a* which is engaged with the bearing 5 of the platen roller 2 wherein the positioning arm is integrated with the thermal head side or by providing an engagement positioning member such as a combination of the engaging pin and an engaging hole instead of the positioning arm for positioning the thermal head relative to the platen roller in the paper feeding direction.

The side to be movable by the linear moving mechanism is not limited to the thermal head or the platen roller but both the thermal head and the platen roller may be movable by the linear moving mechanism.

The following effects can be obtained by the present invention.

It is possible to position the thermal head relative to the platen roller in the paper feeding direction by such a simple structure that at least one of the thermal head and the platen roller is movable toward or away from the other by the linear moving mechanism without using the exclusive assembling instrument. As a result, with such a simple structure, the parts of the thermal printer can be reduced and the thermal printer can be miniaturized.

What is claimed is:

1. A thermal printer for feeding a direct thermal paper between a thermal head and a platen roller, and for printing on said direct thermal paper by heating a heating portion of said thermal head, the thermal printer comprising:

a frame member having a linear moving mechanism which is movably supported by said frame member, said frame member having another portion which is fixed, said linear moving mechanism of said frame member supporting said thermal head, and said another portion of said frame member rotatably supporting said platen roller, such that said thermal head and said platen roller are movable relative to each other;

said linear moving mechanism supported by said frame member supporting said thermal head for linear movement relative to said frame member in a direction toward and away from said platen roller, said direction toward said platen roller being a pressure application direction; and pressure application means for urging said thermal head toward said platen roller so as to cause movement of said thermal head linearly in said pressure application direction;

wherein said linear moving mechanism includes slots, and further includes a head plate in surface contact with said frame member carrying said thermal head and having portions slidable in said slots such that said thermal head is carried on said head plate which is guided so as to be linearly movable.

2. A thermal printer for feeding a direct thermal paper between a thermal head and a platen roller, and for printing on said direct thermal paper by heating a heating portion of said thermal head, the thermal printer comprising:

a frame member having a linear moving mechanism which is movably supported by said frame member, said frame member having another portion which is fixed, said linear moving mechanism of said frame member rotatably supporting said platen roller, and said another portion of said frame member supporting said thermal head, such that said platen roller and said thermal head are movable relative to each other;

said linear moving mechanism supported by said frame member supporting said platen roller for linear movement relative to said frame member in a direction toward and away from said thermal head, said direction toward said thermal head being a pressure application direction; and pressure application means for urging said platen roller toward said thermal head so as to cause movement of said platen roller linearly in said pressure application direction;

wherein said linear moving mechanism includes slots, and further includes a platen roller supporting member in surface contact with said frame member carrying said platen roller and having portions slidable in said slots such that said platen roller is carried on said platen roller supporting member which is guided so as to be linearly movable.

3. A thermal printer for feeding a thermal transfer ribbon and a printing paper between a thermal head and a platen roller, and for printing on said printing paper by heating a heating portion of said thermal head, the thermal printer comprising;

a frame member having a linear moving mechanism which is movable supported by said frame member, said frame member having another portion which is fixed, said linear moving mechanism of said frame member supporting said thermal head, and said another portion of said frame member rotatably supporting said platen roller, such that said thermal head and said platen roller are movable relative to each other;

said linear moving mechanism supported by said frame member supporting said thermal head for linear movement relative to said frame member in a direction toward and away from said platen roller, said direction toward said platen roller being a pressure application direction; and pressure application means for urging said thermal head toward said platen roller so as to cause movement of said thermal head linearly in said pressure application direction;

wherein said linear moving mechanism includes slots, and further includes a head plate in surface contact with said frame member carrying said thermal head and having portions slidable in said slots such that said thermal head is carried on said head plate which is guided so as to be linearly movable.

4. A thermal printer for feeding a thermal transfer ribbon and a printing paper between a thermal head and a platen roller, and for printing on said printing paper by heating a heating portion of said thermal head, the thermal printer comprising:

a frame member having a linear moving mechanism which is movably supported by said frame member, said frame member having another portion which is fixed, said linear moving mechanism of said frame member rotatably supporting said platen roller, and said another portion of said frame member supporting said thermal head, such that said platen roller and said thermal head are movable relative to each other;

said linear moving mechanism supported by said frame member supporting said platen roller for linear movement relative to said frame member in a direction toward and away from said thermal head, said direction toward said thermal head being a pressure application direction; and pressure application means for urging said platen roller toward said thermal head so as to cause movement of said platen roller linearly in said pressure application direction;

wherein said linear moving mechanism includes slots, and further includes a platen roller supporting member in surface contact with said frame member carrying said platen roller and having portions slidable in said slots such that said platen roller is carried on said platen roller supporting member which is guided so as to be linearly movable.

* * * * *